US009051138B2

(12) United States Patent
Clevers

(10) Patent No.: US 9,051,138 B2
(45) Date of Patent: Jun. 9, 2015

(54) SHEET CONVEYING DEVICE

(71) Applicant: OCE TECHNOLOGIES B.V., Venlo (NL)

(72) Inventor: Ernest J. J. Clevers, Broekhuizenvorst (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 13/839,643

(22) Filed: Mar. 15, 2013

(65) Prior Publication Data

US 2013/0200563 A1 Aug. 8, 2013

Related U.S. Application Data

(63) Continuation of application No. PCT/EP2011/066176, filed on Sep. 19, 2011.

(30) Foreign Application Priority Data

Sep. 27, 2010 (EP) ..... 10179979

(51) Int. Cl.
*B65H 3/08* (2006.01)
*B65H 5/02* (2006.01)
*B65H 5/22* (2006.01)

(52) U.S. Cl.
CPC ..... *B65H 5/021* (2013.01); *B65H 5/224* (2013.01); *B65H 2406/11* (2013.01); *B65H 2406/122* (2013.01); *B65H 2406/31* (2013.01); *B65H 2406/364* (2013.01)

(58) Field of Classification Search
CPC ..... B65H 5/026; B65H 5/226; B65H 5/224; B65H 3/0883; B65H 3/0816; B65H 2404/268; B65H 3/48; B65H 3/128; B65H 3/126; B65H 2406/122; B65H 3/124; B65H 3/10; B65H 29/243; B65H 29/32
USPC ..... 271/98, 97, 96, 94, 90, 264, 275, 276, 271/12, 196, 193
See application file for complete search history.

(56) References Cited

U.S. PATENT DOCUMENTS

| | | | | |
|---|---|---|---|---|
| 6,270,629 | B1 * | 8/2001 | Hill et al. | 162/286 |
| 6,808,358 | B1 | 10/2004 | Mayerberg, II et al. | |
| 7,731,186 | B2 * | 6/2010 | Krause et al. | 271/193 |
| 8,702,098 | B2 * | 4/2014 | Clevers | 271/276 |

(Continued)

FOREIGN PATENT DOCUMENTS

| | | | |
|---|---|---|---|
| DE | 20 2005 005 878 | U1 | 7/2005 |
| EP | 1 063 188 | A2 | 12/2000 |

(Continued)

*Primary Examiner* — Thomas Morrison
(74) *Attorney, Agent, or Firm* — Birch, Stewart, Kolasch & Birch, LLP

(57) ABSTRACT

A sheet conveying device includes a belt arranged to carry sheets from an upstream end to a downstream end of a transport path, the belt having an array of perforations; and an array of suction nozzles arranged below the belt for sucking-in ambient air through the perforations of the belt. At least one blow nozzle is arranged at the downstream end of the transport path for blowing out a gas through the perforations of the belt. The downstream end of the transport path is defined by a deflection roller. A plurality of blow nozzles are formed by circumferential grooves in the peripheral surface of the deflection roller.

17 Claims, 4 Drawing Sheets

(56) References Cited

U.S. PATENT DOCUMENTS

| | | | | |
|---|---|---|---|---|
| 2008/0001347 | A1 | 1/2008 | Krause et al. | |
| 2010/0117293 | A1 * | 5/2010 | Shinohara | 271/264 |

FOREIGN PATENT DOCUMENTS

| | | | |
|---|---|---|---|
| EP | 1 069 060 | A2 | 1/2001 |
| JP | 2006-327725 | * | 12/2006 |

* cited by examiner

SHEET CONVEYING DEVICE

CROSS-REFERENCE TO RELATED APPLICATIONS

This application is a Continuation of International Application No. PCT/EP2011/066176, filed on Sep. 19, 2011, and for which priority is claimed under 35 U.S.C. §120, and which claims priority under 35 U.S.C. §119 to Application No. 10179979.9, filed in Europe on Sep. 27, 2010. The entirety of each of the above-identified applications is expressly incorporated herein by reference.

BACKGROUND OF THE INVENTION

1. Field of the Invention

The present invention relates to a printing system comprising a marking engine for applying a marking substance onto a sheet, and comprising a sheet conveying device, the sheet conveying device comprising a belt arranged to carry the sheets from an upstream end to a downstream end of a transport path, the belt having an array of perforations; an array of suction nozzles being arranged below the belt for sucking-in ambient air through the perforations of the belt; and at least one blow nozzle arranged at the downstream end of the transport path for blowing out a gas through the perforations of the belt.

2. Background of the Invention

Conveyor belts are frequently used for conveying sheets of paper, plastic film or the like through a sheet handling apparatus such as a printer or a copier. In many applications, e.g. an inkjet printer, it is important that the sheets are reliably held in a stable position on the belt so as to be conveyed through the apparatus with high accuracy, and/or the sheets are held flat on the belt, i.e. without forming any cockles. For that purpose, it is known to provide an array of suction nozzles below the belt, distributed along and across the transport path, so that a suction pressure is generated which draws the sheets against the belt and holds them safely in position.

When the sheets reach the downstream end of the transport path, they must reliably be separated from the belt so that they may either be discharged onto a tray or may be passed over to a subsequent conveying device, e.g. a set of conveyor rollers or another conveyor belt. Sometimes, the sheets tend to stick to the belt, because the sheet material is sticky or because a static charge is developed, which attracts the sheet against the belt. When the leading edge of the sheet is not separated quickly enough from the belt, a jam is likely to occur, or the sheet may be damaged.

Typically, the belt is deflected at a deflection roller at the downstream end of the transport path and the tendency of the sheet to stick to the belt may be reduced by reducing the radius of the deflection roller or by deflecting the belt at a relatively sharp knife-edge, so that the flexibility of the sheet is no longer sufficient for the sheet to follow the sharp turn of the belt. However, such a sharp turn may also cause strains in the belt itself, so that the lifetime of the belt is reduced. In order to mitigate this problem, it would be possible to increase the flexibility of the belt, which however, would make it even more difficult to assure the required transport accuracy and reliability.

It is generally known that the separation of the sheets from the belt may be assisted by blowing a stream of air against the leading edge of the sheet when it leaves the transport path at the downstream end.

US 2008/001347 A1 describes a sheet transport apparatus, in which a sheet is placed on an area of a transport belt and is held to the circulating transport belt by a negative pressure applied through the belt in a first suction unit. The transport belt is at least partially air permeable and, for example, has through openings in the shape of perforations. Electrical charges are applied to the transport belt in order to generate electrostatic holding forces between the transport belt and the sheet. In a printing module, only electrostatic forces hold the sheet, and a toner image is generated on the sheet. In a second suction unit, negative pressure is applied again, and a neutralizing unit neutralizes electrical charges on the transport belt. Downstream of the neutralizing unit, the sheet is lifted off the transport belt at a first blowing unit and is then further moved by the transport belt until it reaches an area of a guide roller. In this area, a second blowing unit is arranged within the hollow cylindrical body of the guide roller. Air is blown through openings in the hollow cylindrical body of the guide roller and through the transport belt.

SUMMARY OF THE INVENTION

It is an object of the present invention to provide a sheet conveying device which assures a high transport accuracy and reliability and also assures that the sheet is reliably separated from the belt at the end of the transport path.

According to the present invention, this object is achieved by a plurality of blow nozzles being formed by circumferential grooves in the peripheral surface of the deflection roller. In particular, a sheet conveying device is provided comprising a belt arranged to carry the sheets from an upstream end to a downstream end of a transport path, the belt having at least one array of perforations; and at least one array of suction nozzles arranged below the belt for sucking-in ambient air through the perforations of the belt, wherein at least one blow nozzle is arranged at the downstream end of the transport path for blowing out a gas through the perforations of the belt, wherein the downstream end of the transport path is defined by a deflection roller, and wherein a plurality of blow nozzles is formed by circumferential grooves in the peripheral surface of the deflection roller, wherein each circumferential groove is aligned with one of the at least one array of suction nozzles.

By blowing out air or any other gas through the perforations of the belt at the end of the transport path, it is possible to lift the leading edge of the sheet off the belt already before the leading edge actually reaches the end of the transport path where the belt makes a turn. As a result, the sheet can more reliably and quickly be separated from the belt. The same perforations in the belt that are used for drawing the sheet against the belt in the upstream part of the transport path may also be used for blowing out the air at the downstream end, so that the present invention may be implemented without modifying the configuration of the belt.

Useful details and optional features of the present invention are indicated in the dependent claims.

According to the present invention, the plurality of blow nozzles is provided in the peripheral surface of the deflection roller. The plurality of blow nozzles is formed by circumferential grooves in the peripheral surface of the deflection roller. Each circumferential groove is aligned with one of the at least one array of suction nozzles. The array of suction nozzles is arranged below the belt for sucking-in ambient air through the perforations of the belt. As a result, each of the circumferential grooves is aligned with one of the at least one arrays of perforations of the belt, so that the air discharged by the blow nozzles can readily pass through the perforations. This embodiment provides a simple construction for blowing out air or any other gas through the perforations of the belt from inside the deflection roller.

In addition, blow nozzles may also be arranged immediately upstream of the deflection roller which defines the end of the transport path. For example, blow nozzles may be incorporated in a nozzle body that also forms the suction nozzles.

According to a further development of the present invention, additional blow nozzles may be distributed along and across the entire transport path, forming an alternating pattern with the suction nozzles. This has the advantage that the part of the belt that spans the distance between an upstream and a downstream deflection roller may be supported on an air cushion that is created by the blow nozzles, so that frictional resistance and deflection of the conveyor belt are reduced. The air that is blown out by the blow nozzles, except the blow nozzles immediately at the end of the transport path, will readily be sucked-in again by the suction nozzles, so that a short-circuited air flow is created on the bottom side of the belt. Since the dynamic pressure in this air flow will be lower than the ambient pressure, the sheet is still drawn against the top surface of the belt. Of course, the force with which the sheets are attracted may be increased as desired by increasing the flow rate through the suction nozzles relative to the flow rate through the blow nozzles.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMEMTS

Figure 1:
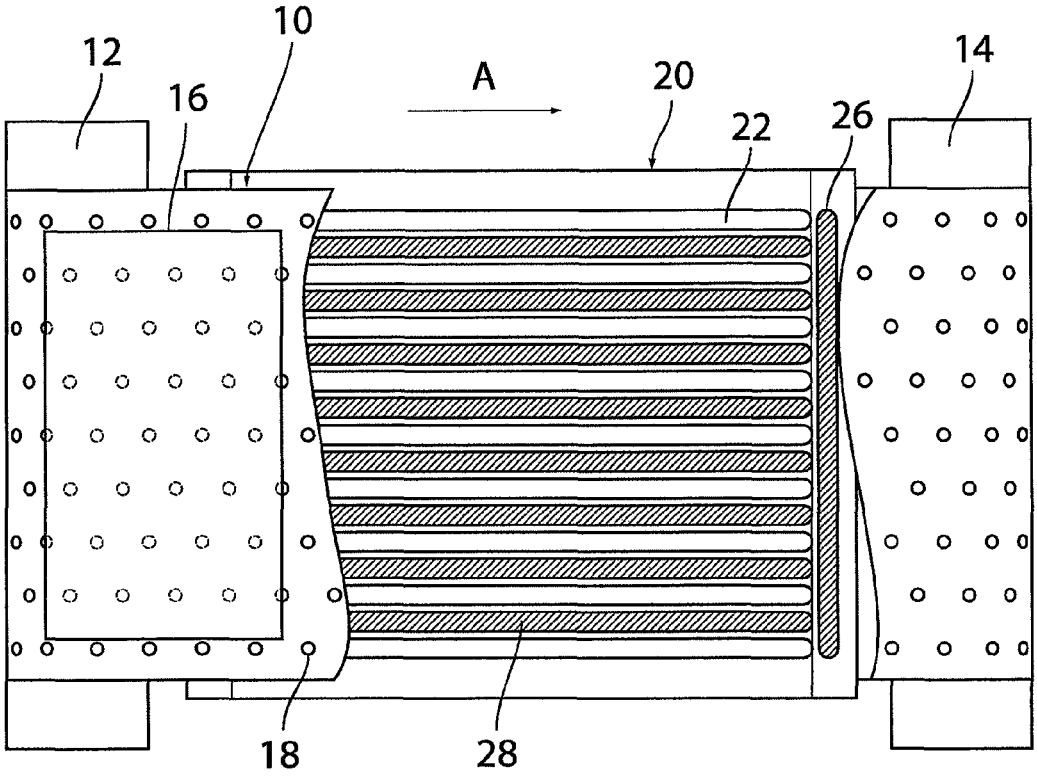
FIG. 1 is a top plan view of a sheet conveying device, illustrating features of the present invention, with a part of a conveyor belt being broken away.

The present invention will now be described with reference to the accompanying drawings, wherein the same or similar elements are identified with the same reference numeral.

As is shown in FIG. 1, a belt 10 is passed around an upstream deflection roller 12 and a downstream deflection roller 14, so that a top portion of the belt forms a transport path for conveying sheets 16, e. g. print substrates or the like. At least one of the deflection rollers 12, 14 is actively driven, so that the top portion of the belt 10 moves in the direction indicated by an arrow A and conveys the sheets 16 that have been placed on the belt in that direction.

The belt 10 has an array of perforations 18 that are evenly distributed over the entire surface area of the belt and are aligned in rows that extend in the conveying direction A.

A plate-like nozzle body 20 is disposed between the deflection rollers 12, 14 and extends over the entire width and almost the entire length of the transport path. A series of slot-like suction nozzles 22 are formed in the flat top surface of the nozzle body 20 and extend in the row direction of the perforations 18, each suction nozzle 22 being aligned with one of the rows of the perforations 18.

Figure 2:
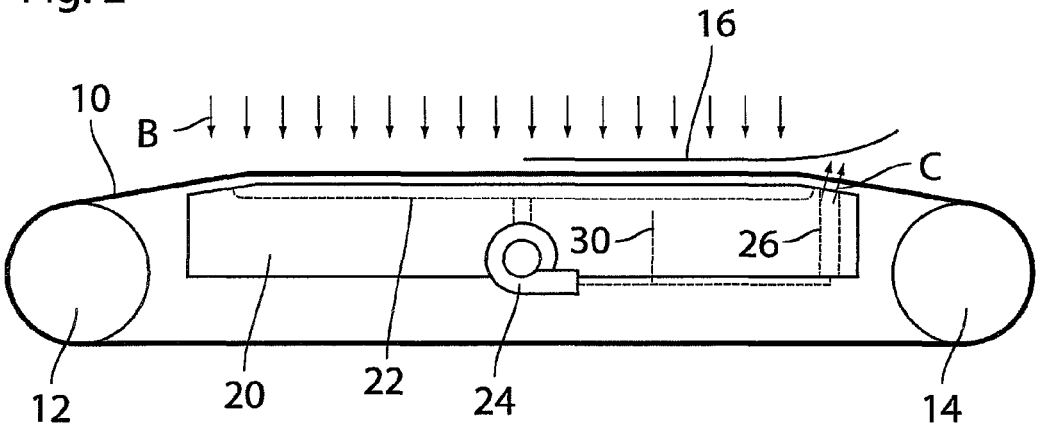
FIG. 2 is a schematic side-elevational view of the device shown in FIG. 1.

As is shown in FIG. 2, the top surface of the nozzle body 20 is slightly elevated above the top apex of the deflection rollers 12, 14, so that the top portion of the belt 10 does not freely span the distance between the deflection rollers 12, 14 but is supported by the nozzle body 20.

As is further shown in FIG. 2, the suction nozzles 22 communicate with a suction port of a blower 24, so that air is drawn-in through the perforations 18 of the belt 10, as has been symbolized by arrows B in FIG. 2. As a result, the sheet 16 will be firmly drawn against the surface of the belt 10 and will be held flat on the belt as long as it moves along the transport path together with the belt. This reliably prevents the sheets 16 from being distorted or shifted relative to the belt, so that the sheets can be conveyed with high transport accuracy and high reliability.

FIG. 2 illustrates a condition in which the leading edge of the sheet 16 is about to reach the downstream end of the transport path as defined by the deflection roller 14. Here, the nozzle body 20 forms a slot-like blow nozzle 26 that extends across the entire width of the transport path immediately upstream of the deflection roller 14. This blow nozzle 26 communicates with the discharge port of the blower 24, so that at least a part of the air that has been sucked-in by the blower 24 is blown out through the blow nozzle 26 and through the perforations 18 when they successively move across the blow nozzle. As has been symbolized by arrows C in FIG. 2, this creates an air flow that is upwardly directed against the leading edge of the sheet 16 and lifts the same from the surface of the belt 10, even before it reaches the apex of the deflection roller 14 where the belt makes a sharp turn. As a result, the leading edge of the sheet 16 is safely separated from the belt 10 so that it may reliably be caught by a subsequent conveying device (not shown) which may be, for example, formed by a nip between two transport rollers, or the like. As the belt 10 and the sheet 16 continue to move beyond the position shown in FIG. 2, the entire length of the sheet 16 will gradually be separated from the belt 10 as it passes over the blow nozzle 26.

In this example, as is shown in FIG. 1, the top surface of the nozzle body 20 is also formed with a series of anti-friction blow nozzles 28 which extend in parallel with the suction nozzles 22 and are arranged alternatingly therewith. For illustration purposes and for facilitating the distinction between the blow nozzles 26, 28 and the suction nozzles 22, the blow nozzles have been hatched in FIG. 1.

A distribution manifold 30, which has only schematically been shown in FIG. 2, connects the array of anti-friction blow nozzles 28 to the discharge port of the blower 24, so that a part of the air that has been drawn in by the blower is discharged upwardly against the belt 10 via the blow nozzles 28. As can be seen in FIG. 1, the blow nozzles 28 are aligned with the gaps between the rows of perforations 18, so that the air ejected by the blow nozzles 28 will impinge on non-perforated parts of the belt 10. As a result, an air cushion is formed between the bottom surface of the belt 10 and the top surface of the nozzle body 20, so that the belt can pass over the nozzle body with reduced friction. This reduces not only a wear and distortion of the belt 10 carrying the sheets 16 but also facilitates the separation of the sheets from the belt by means of the blow nozzle 26 at the downstream end.

Since the air current discharged by the blower 24 is divided between the blow nozzle 26 and the distribution manifold 30, the flow rate of air discharged through the anti-friction blow nozzles 28 is smaller than the flow rate of air sucked-in by the suction nozzles 22, resulting in a net force that attracts the sheet 16 towards the belt. Of course, it would also be possible to provide separate blowers for the blow nozzle 26 and the distribution manifold 30 and/or to provide a distribution valve for controlling the flow rate of air through the anti-friction blow nozzles 28. In yet another embodiment, the anti-friction blow nozzles 28 may be connected directly to the blow nozzle 26.

Figure 3:
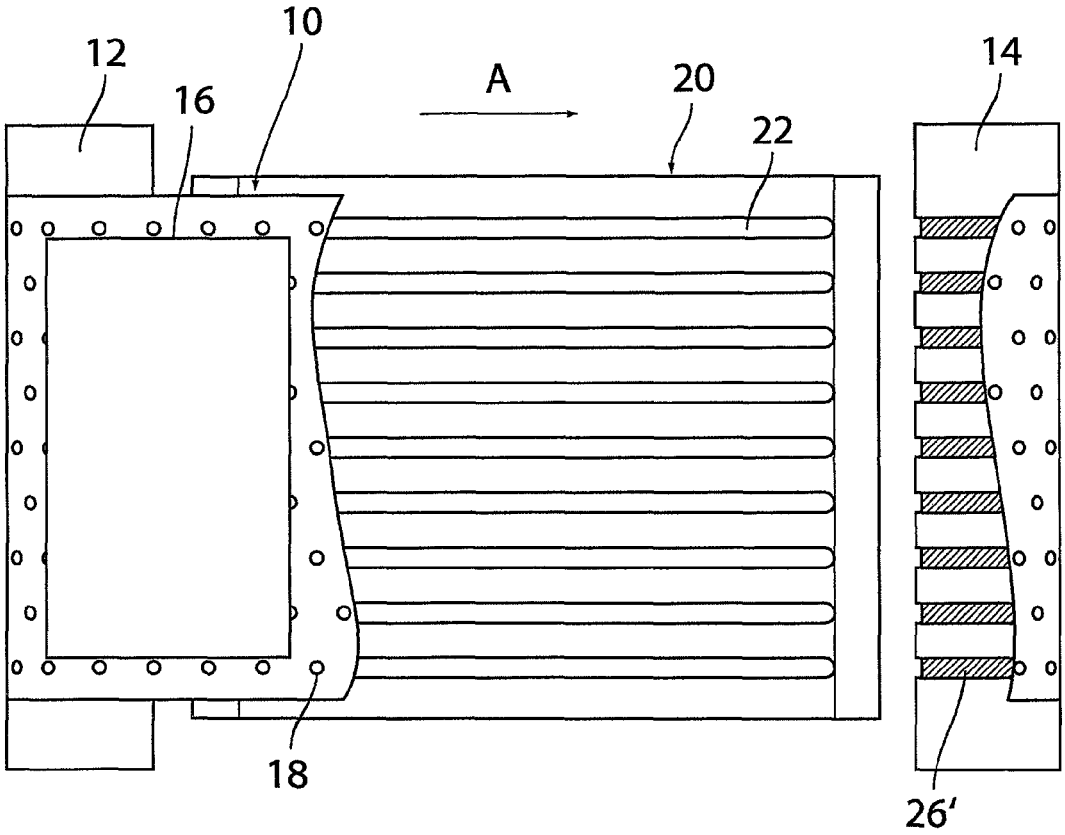
FIG. 3 shows a top plan view of a sheet conveying device according to the present invention.
Figure 4:
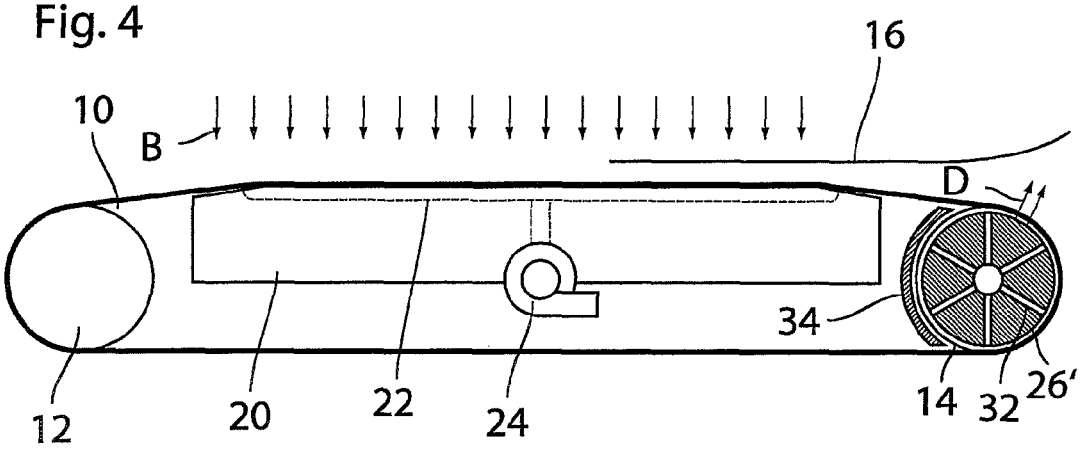
FIG. 4 is a side-elevation of the device shown in FIG. 3, with a deflection roller for the belt being shown in cross-section.

FIGS. 3 and 4 illustrate an embodiment of the present invention, in which the nozzle body 20 has neither the blow nozzle 26 at the downstream end nor the longitudinally extending anti-friction blow nozzles 28. Instead, an array of blow nozzles 26' is formed in the peripheral surface of the deflection roller 14. These blow nozzles 26' take the form of circumferential grooves in the surface of the deflection roller 14.

As is shown in FIG. 4, the deflection roller 14 has an international distribution manifold connecting the blow nozzles 26' via a rotary connector (not shown) to the blower 24 or to a separate blower. As a result, an air flow, symbolized by arrows D in FIG. 4, is ejected radially from the surface of deflection roller 14 and through the perforations 18 of the belt 10, so that the leading edge of the sheet 16 is readily separated from the belt. As can be seen in FIG. 3, the blow nozzles 26 are aligned with the suction nozzles 22 and, consequently, with the rows of perforations 18, so that the air discharged by the blow nozzles can readily pass through the perforations 18. Additional baffle plates 34 may be provided around the peripheral surface of the deflection roller 14 so as to concentrate the air flow to the peripheral region that faces the sheet 16.

In this embodiment, the position where the sheet 16 is separated from the belt 10 is shifted towards the downstream end of the transport path as compared to the example shown in FIGS. 1 and 2.

Figure 5:
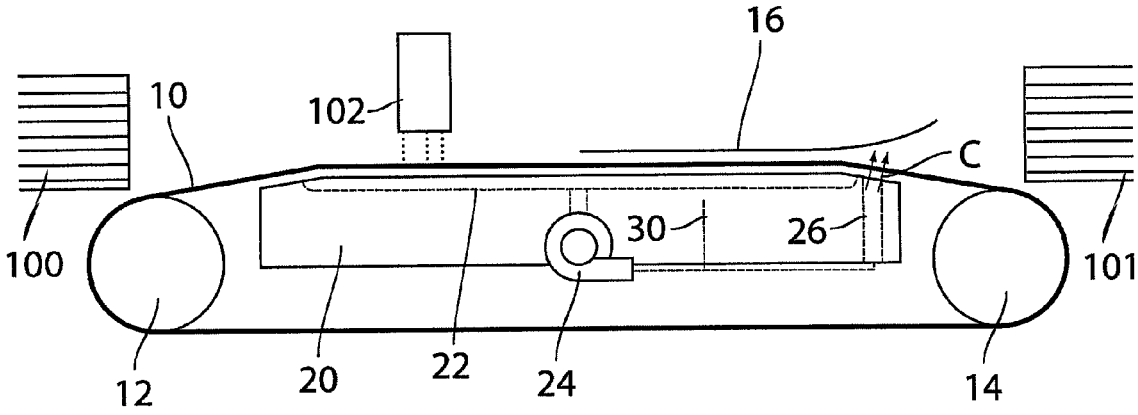
FIG. 5 illustrates a printing system in accordance with the present invention.

FIG. 5 illustrates a printing system in accordance with the present invention. The printing system comprises a media supply station 100 where the sheets of printing substrates are supplied towards the marking engine 102. This marking engine 102 is a piezo-based inkjet page wide array, but may alternatively comprise any type of marking process, such as, e.g. a thermal or piezo-based scanning or a page wide inkjet process, an electro(photo)graphic process, a magnetographic process, or the like. The marking engine applies an image of marking substance onto the sheet of printing substrate such as, e.g. a sheet of paper, cloth, plastics, etc. After applying the image of marking substance onto the printing substrate, the printing substrate is fed towards the delivery station, where a sheet may be collected by an operator, or fed towards one or more post-processing units, such as, e.g. a stacking unit, a folding device and/or any binding device. The printing system utilizes the sheet conveying device as described hereinabove to transport the sheet of printing substrate during the complete path from media supply station towards the media delivery station 101, or during a portion thereof FIG. 5 illustrates the use of such a sheet conveying device during the traverse of the sheet along the marking engine, as this conveying requires a large precision in positioning.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Figure 6:
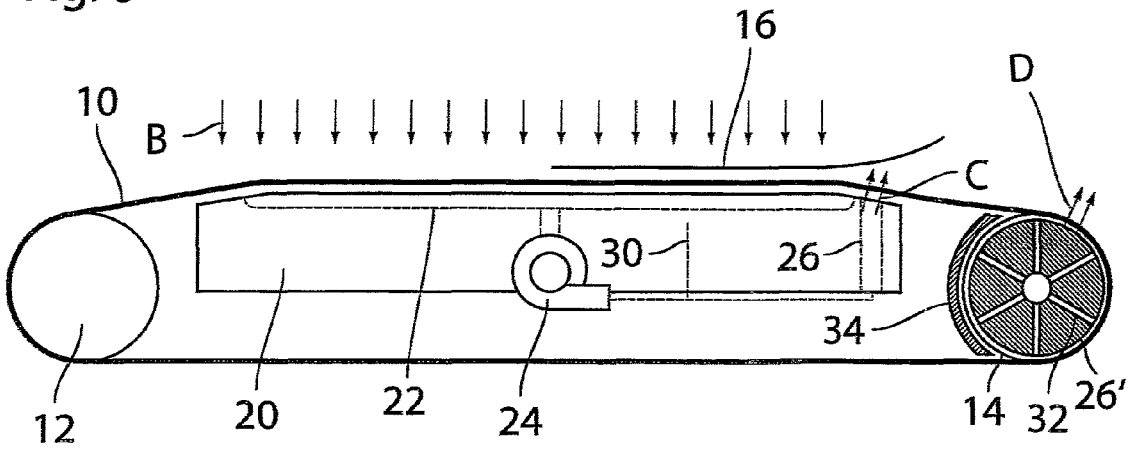
FIG. 6 is a side-elevation of a device according to the present invention.

For example, the embodiment of FIGS. 3 and 4 has been described as including only a plurality of blow nozzles 26', i.e. the nozzle body 20 has neither the blow nozzle 26 at the downstream end nor the longitudinally extending anti-friction blow nozzles 28 as illustrated in FIGS. 1 and 2. However, one having ordinary skill in the art would recognize that the embodiment of FIGS. 3 and 4 could include a nozzle body 20 that includes the blow nozzle 26 at the downstream end and/or the longitudinally extending anti-friction blow nozzles 28 as in the embodiment of FIGS. 1 and 2. FIG. 6 illustrates this embodiment of the present invention. It should also be understood that the embodiment of FIG. 6 could also include the longitudinally extending anti-friction blow nozzles 28 as illustrated in FIG. 1.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet conveying device, comprising:

a belt arranged to carry sheets from an upstream end to a downstream end of a transport path, the belt having at least one array of perforations;

at least one array of suction nozzles arranged below the belt for sucking-in ambient air through the perforations of the belt; and at least one blow nozzle arranged at the downstream end of the transport path for blowing out a gas through the perforations of the belt, wherein the downstream end of the transport path is defined by a deflection roller, wherein a plurality of blow nozzles is formed by circumferential grooves in the peripheral surface of the deflection roller, each of the circumferential grooves being aligned with one of the at least one array of suction nozzles, wherein each of the circumferential grooves has a length in a circumferential direction and a width in an axial direction of the deflection roller, the length being greater than the width, wherein the at least one array of perforations include rows of perforations, and wherein the air flow provided by each of the circumferential grooves is aligned with a row of perforations of the belt.

2. The conveying device according to claim 1, wherein at least one blow nozzle is arranged immediately upstream of the deflection roller.

3. The conveying device according to claim 2, wherein the at least one blow nozzle arranged immediately upstream of the deflection roller is configured as a slot that extends across the entire width of the transport path.

4. The conveying device according to claim 2, wherein the at least one blow nozzle arranged immediately upstream of the deflection roller and the suction nozzles are formed in a common nozzle body.

5. The conveying device according to claim 1, wherein the grooves are connected to a blower via an internal distribution manifold in the deflection roller.

6. The conveying device according to claim 1, wherein the perforations are aligned in rows that extend in the conveying direction, and the at least one array of suction nozzles are aligned with the rows of perforations.

7. The conveying device according to claim 6, wherein the blow nozzles formed by circumferential grooves in the peripheral surface of the deflection roller are aligned with the rows of perforations.

8. The conveying device according to claim 1, further comprising a blower having a suction port connected to the suction nozzles and a discharge port connected to the at least one blow nozzle.

9. The conveying device according to claim 1, further comprising an array of anti-friction blow nozzles interleaved with the array of suction nozzles and connected to a blower for blowing-out a gas towards the bottom surface of the belt.

10. A printing system, comprising:

a media input station;

a marking engine for applying a marking substance onto a sheet;

a delivery station; and a sheet conveying device in accordance with claim 1.

11. The conveying device according to claim 1, wherein the circumferential grooves extend about an entire circumference of the deflection roller.

12. The conveying device according to claim 1, wherein each of the circumferential grooves is configured to eject an air flow radially from the surface of the deflection roller.

13. The conveying device according to claim 1, wherein each of the circumferential grooves extends about an entire circumference of the deflection roller.

14. A sheet conveying device, comprising:

a belt arranged to carry sheets from an upstream end to a downstream end of a transport path, the belt having at least one array of perforations;

at least one array of suction nozzles arranged below the belt for sucking-in ambient air through the perforations of the belt;

at least one blow nozzle arranged at the downstream end of the transport path for blowing out a gas through the perforations of the belt; and an array of anti-friction blow nozzles interleaved with the array of suction nozzles and connected to a blower for blowing-out a gas towards the bottom surface of the belt, wherein the downstream end of the transport path is defined by a deflection roller, wherein a plurality of blow nozzles is formed by circumferential grooves in the peripheral surface of the deflection roller, each of the circumferential grooves being aligned with one of the at least one array of suction nozzles, wherein the at least one array of perforations include rows of perforations, and wherein the air flow provided by each of the circumferential grooves is aligned with a row of perforations of the belt.

15. The conveying device according to claim 14, wherein each of the circumferential grooves is configured to eject an air flow radially from the surface of the deflection roller.

16. The conveying device according to claim 14, wherein each of the circumferential grooves extends about an entire circumference of the deflection roller.

17. A sheet conveying device, comprising:

a belt arranged to carry sheets from an upstream end to a downstream end of a transport path, the belt having at least one array of perforations;

at least one array of suction nozzles arranged below the belt for sucking-in ambient air through the perforations of the belt; and at least one blow nozzle arranged at the downstream end of the transport path for blowing out a gas through the perforations of the belt, wherein the downstream end of the transport path is defined by a deflection roller, wherein a plurality of blow nozzles is formed by circumferential grooves in the peripheral surface of the deflection roller, each of the circumferential grooves being aligned with one of the at least one array of suction nozzles, wherein each of the circumferential grooves has a length in a circumferential direction and a width in an axial direction of the deflection roller, the length being greater than the width, and wherein each of the circumferential grooves extends about an entire circumference of the deflection roller.

* * * * *